US011689872B2

(12) United States Patent
Watanabe et al.

(10) Patent No.: US 11,689,872 B2
(45) Date of Patent: Jun. 27, 2023

(54) ACOUSTIC DEVICE WITH FIRST SOUND OUTPUTTING DEVICE FOR INPUT SIGNAL, SECOND OUTPUTTING DEVICE FOR MONAURAL SIGNAL AND L-CHANNEL STEREO COMPONENT AND THIRD SOUND OUTPUTTING DEVICE FOR MONAURAL SIGNAL AND R-CHANNEL STEREO COMPONENT

(71) Applicant: Faurecia Clarion Electronics Co., Ltd., Saitama (JP)

(72) Inventors: Tetsuo Watanabe, Saitama (JP); Akiko Nakamura, Saitama (JP); Yasuhiro Fujita, Saitama (JP); Chihiro Kuwayama, Saitama (JP)

(73) Assignee: Faurecia Clarion Electronics Co., Ltd., Saitama (JP)

( * ) Notice: Subject to any disclaimer, the term of this patent is extended or adjusted under 35 U.S.C. 154(b) by 0 days.

(21) Appl. No.: 17/540,330

(22) Filed: Dec. 2, 2021

(65) Prior Publication Data

US 2022/0182774 A1 Jun. 9, 2022

(30) Foreign Application Priority Data

Dec. 9, 2020 (JP) ..... 2020-203962

(51) Int. Cl.

| | |
|---|---|
| ***H04R 3/00*** | (2006.01) |
| ***H04S 3/00*** | (2006.01) |
| ***H04R 5/02*** | (2006.01) |
| ***H04R 5/04*** | (2006.01) |

(52) U.S. Cl.

CPC ..... *H04S 3/002* (2013.01); *H04R 5/02* (2013.01); *H04R 5/04* (2013.01); *H04S 3/008* (2013.01); *H04R 2499/13* (2013.01); *H04S 2400/05* (2013.01); *H04S 2420/07* (2013.01)

(58) Field of Classification Search

CPC ..... H04S 3/002; H04S 3/008; H04S 2400/05; H04S 2420/07; H04R 5/02; H04R 5/04; H04R 2499/13

See application file for complete search history.

(56) References Cited

U.S. PATENT DOCUMENTS 9,197,963 B1 * 11/2015 North ..... H04S 5/00
2017/0272884 A1 * 9/2017 Aoki ..... H04S 5/005

FOREIGN PATENT DOCUMENTS

JP 2011-228956 A 11/2011

* cited by examiner

*Primary Examiner* — Jason R Kurr
(74) *Attorney, Agent, or Firm* — IP Business Solutions, LLC

(57) ABSTRACT

An acoustic device includes: a generating unit that generates a monaural signal on the basis of a left stereo signal and a right stereo signal in a low frequency band; an extracting unit that extracts a stereo component for an L-channel and a stereo component for an R-channel on the basis of a left stereo signal and a right stereo signal in a high frequency band; a first combining unit that combines the monaural signal and the stereo component for the L-channel; and a second combining unit that combines the monaural signal and the stereo component for the R-channel.

3 Claims, 4 Drawing Sheets

ACOUSTIC DEVICE WITH FIRST SOUND OUTPUTTING DEVICE FOR INPUT SIGNAL, SECOND OUTPUTTING DEVICE FOR MONAURAL SIGNAL AND L-CHANNEL STEREO COMPONENT AND THIRD SOUND OUTPUTTING DEVICE FOR MONAURAL SIGNAL AND R-CHANNEL STEREO COMPONENT

INCORPORATION BY REFERENCE

The present application claims priority under 35 U.S.C. § 119 to Japanese Patent Application No. 2020-203962 filed on Dec. 9, 2020. The content of the application is incorporated herein by reference in its entirety.

BACKGROUND OF THE INVENTION

Field of the Invention

The present invention relates to an acoustic device.

Description of the Related Art

There is conventionally known, as an acoustic device for a vehicle, a technology disclosed in Japanese Patent Laid-Open No. 2011-228956 (hereinafter referred to as Patent Literature 1). The device described in Patent Literature 1 includes vibrating means which outputs a sound by vibrating a structure body constituting a vehicle cabin of a vehicle, the structure body being provided closer to the position where a listener is seated than the center line of the vehicle along the longitudinal direction as the vehicle is seen from above.

SUMMARY OF THE INVENTION

When a new sound outputting device is added to an acoustic system having been installed in the vehicle to expand the acoustic system, this has increased the number of channels and it has been needed to add amplifiers and devices for signal processing and/or to modify the configuration.

The present invention is devised in view of the aforementioned circumstances, and an object thereof is to provide an acoustic device to which a sound outputting device is added without changing the number of output channels, and for which sound quality is improved.

In order to solve the aforementioned problem, there is provided an acoustic device according to an aspect of the present invention, including: a band separating unit that separates a frequency band for input L-channel acoustic signal and R-channel acoustic signal into a first frequency band and a second frequency band which is a frequency band different from the first frequency band; a generating unit that generates a monaural signal on the basis of the L-channel acoustic signal that is in the first frequency band and the R-channel acoustic signal that is in the first frequency band; an extracting unit that extracts a stereo component for an L-channel and a stereo component for an R-channel on the basis of the L-channel acoustic signal that is in the second frequency band and the R-channel acoustic signal that is in the second frequency band; a first combining unit that combines the monaural signal and the stereo component for the L-channel to generate a first combined signal; a second combining unit that combines the monaural signal and the stereo component for the R-channel to generate a second combined signal; a first sound outputting device that outputs, into a space, a sound based on the input L-channel acoustic signal and R-channel acoustic signal; a second sound outputting device that outputs, into the space, a sound based on the first combined signal; and a third sound outputting device that outputs, into the space, a sound based on the second combined signal.

According to an aspect of the present invention, there can be provided an acoustic device to which a sound outputting device is added without changing the number of output channels, and for which sound quality is improved.

DETAILED DESCRIPTION OF THE PREFERRED EMBODIMENTS

Figure 1:
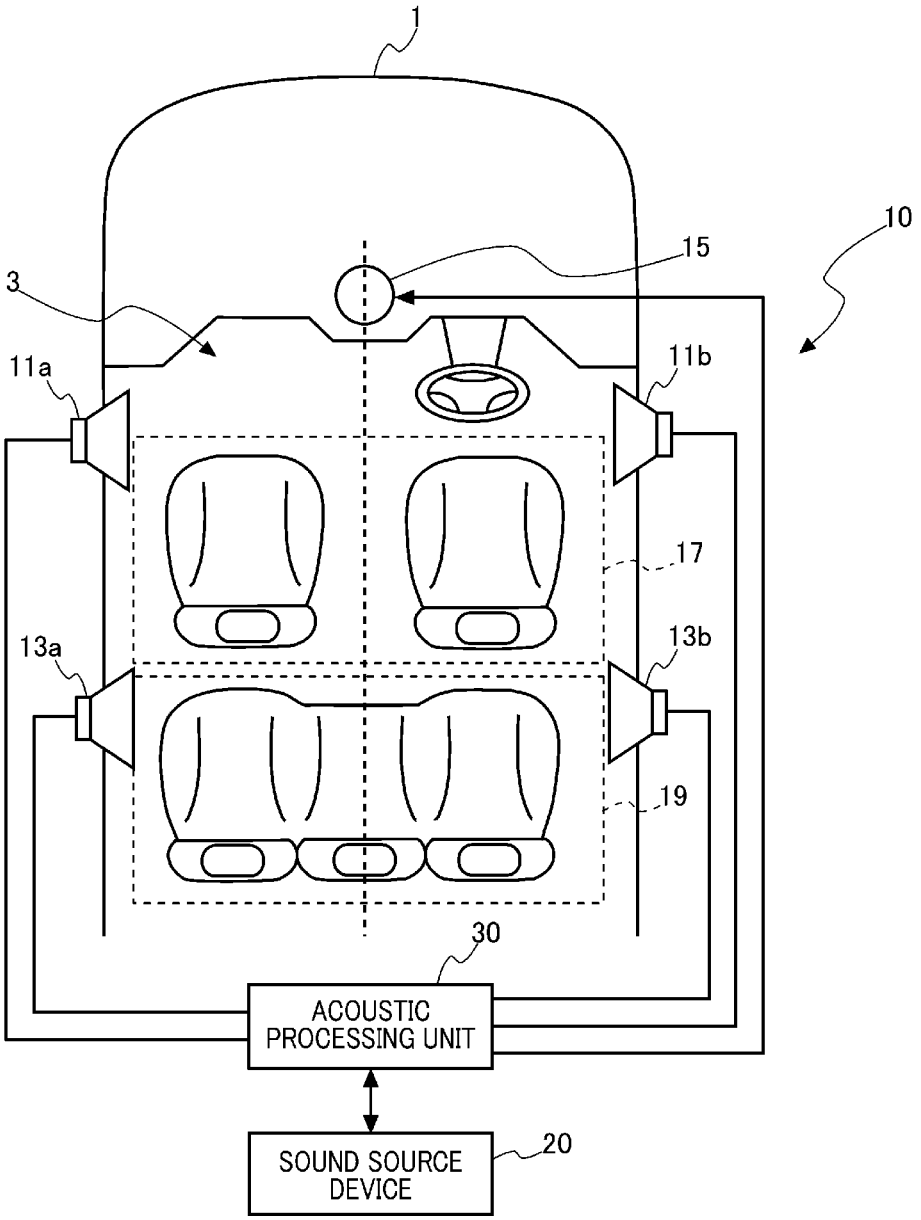
FIG. 1 is a diagram showing a configuration of a vehicle including an acoustic device.

FIG. 1 is a diagram showing a configuration of a vehicle 1 including an acoustic device 10 to which the present invention is applied.

The acoustic device 10 includes a left front loudspeaker 11*a*, a right front loudspeaker 11*b*, a left rear loudspeaker 13*a*, a right rear loudspeaker 13*b*, an exciter 15 and an acoustic processing device 30.

The left front loudspeaker 11*a*, the right front loudspeaker 11*b*, the left rear loudspeaker 13*a*, the right rear loudspeaker 13*b* and the exciter 15 are installed in a vehicle cabin 3 (space) of the vehicle 1.

The left front loudspeaker 11*a* is installed on the inner side of a left front door of the vehicle 1 and outputs a sound toward a front seat 17 of the vehicle cabin 3. The right front loudspeaker 11*b* is installed on the inner side of a right front door of the vehicle 1 and outputs a sound toward the front seat 17 of the vehicle cabin 3. The left front loudspeaker 11*a* and the right front loudspeaker 11*b* correspond to a first sound outputting device.

The left rear loudspeaker 13*a* is installed on the inner side of a left rear door of the vehicle 1 and outputs a sound toward a rear seat 19 of the vehicle cabin 3. The right rear loudspeaker 13*b* is installed on the inner side of a right rear door of the vehicle 1 and outputs a sound toward the rear seat 19 of the vehicle cabin 3. The left rear loudspeaker 13*a* and the right rear loudspeaker 13*b* correspond to a second sound outputting device or a third sound outputting device.

The exciter 15 corresponds to the third sound outputting device or the second sound outputting device and is arranged on the center line of the vehicle cabin 3 in the vehicle width direction and on the ceiling of the vehicle cabin 3, the center line being along a longitudinal direction of the vehicle cabin 3. The exciter 15 outputs a sound by delivering vibration to, and thereby, vibrating a ceiling material of the vehicle cabin 3 with this ceiling material being as a vibrating plate, the vibration being transmitted from a not-shown voice coil. While in the present embodiment, a case where the exciter 15 is provided on the ceiling of the vehicle cabin 3 is described as an example, there may be employed a configuration in which a center loudspeaker is used in place of the exciter 15. Moreover, the exciter 15 or the center loudspeaker may be installed, for example, on a dashboard or the like, not limitedly on the ceiling material, as long as it is arranged on a center line in the vehicle width direction.

The acoustic processing device 30 is connected to the sound source device 20. The sound source device 20 outputs a left stereo signal L and a right stereo signal R as acoustic signals, these respectively being a signal on an L-channel and a signal on an R-channel in a 2-channel stereo scheme. The left stereo signal L corresponds to an L-channel acoustic signal and the right stereo signal R corresponds to an R-channel acoustic signal. The left stereo signal L and the right stereo signal R output from the sound source device 20 are input to the acoustic processing device 30.

The sound source device 20 plays content to output the acoustic signals. Examples of the content include audio sources recorded in a CD (Compact Disc), a DVD (Digital Versatile Disc), a BD (Blu-ray® Disc), a hard disc drive, a semiconductor memory or the like. The sound source device 20 is, for example, a reproducing device (player) for the audio recorded in the CD, the DVD, the BD, the hard disc drive, the semiconductor memory or the like. Moreover, the content may be a streamed audio signal which the sound source device 20 receives from an external device such as a server with a wireless communication unit included in the sound source device 20. The sound source device 20 is, for example, a wireless communication device such as a computer (laptop computer, tablet computer), a smartphone or the like, which receives the audio signal distributed from the server computer.

Figure 2:
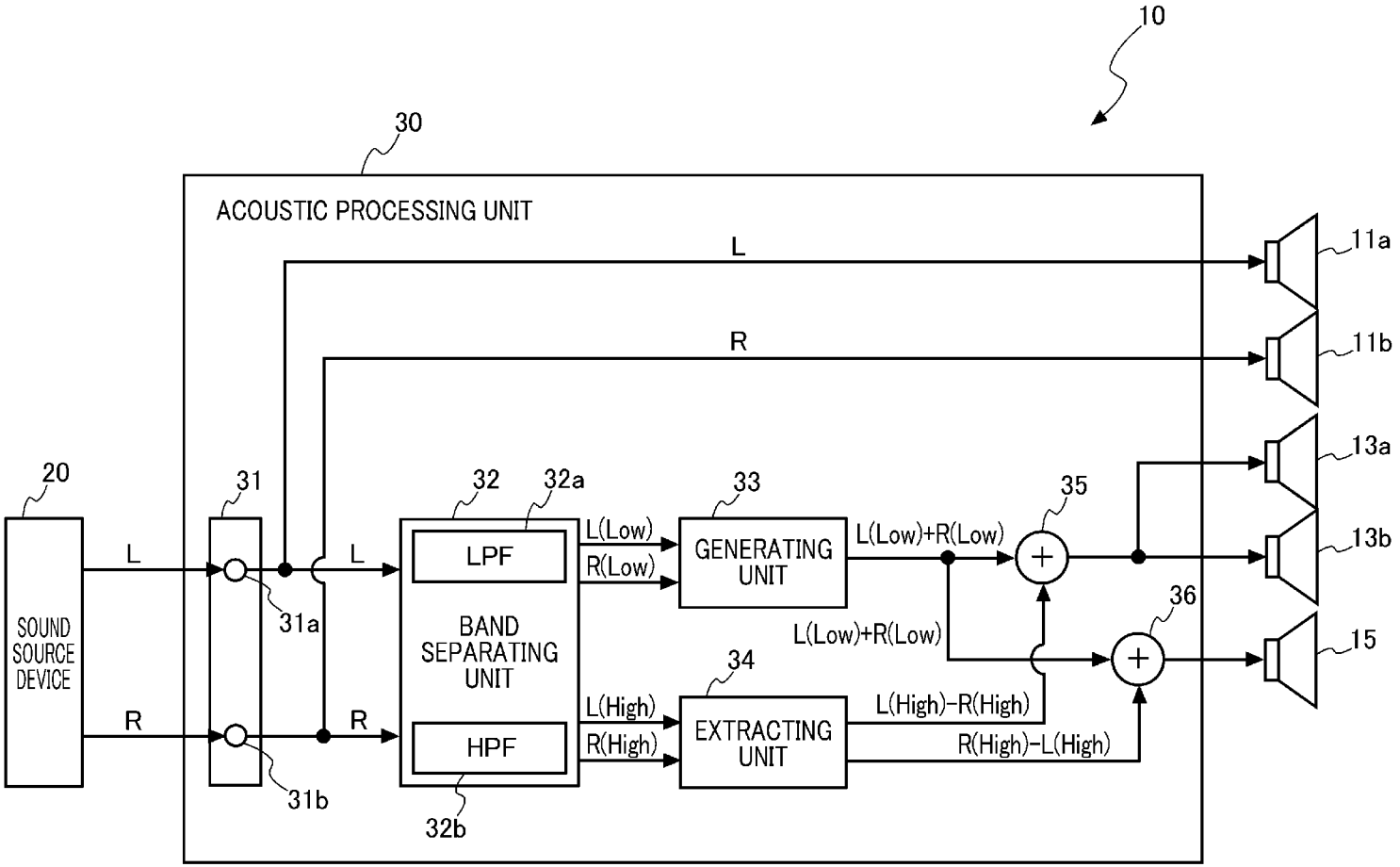
FIG. 2 is a block diagram showing a configuration of an acoustic processing device.

FIG. 2 is a block diagram showing a configuration of the acoustic processing device 30.

Next, the configuration of the acoustic processing device 30 is described with reference to FIG. 2.

The acoustic processing device 30 includes an input unit 31, a band separating unit 32, a generating unit 33, an extracting unit 34, a first combining unit 35 and a second combining unit 36.

The input unit 31 is an input unit which the left stereo signal L and the right stereo signal R which are output from the sound source device 20 are input to, and includes a first input terminal 31*a* and a second input terminal 31*b*.

To the first input terminal 31*a*, the left stereo signal L is input from the sound source device 20. The left stereo signal L input to the first input terminal 31*a* is output to the left front loudspeaker 11*a* and the band separating unit 32.

To the second input terminal 31*b*, the right stereo signal R is input from the sound source device 20. The right stereo signal R input to the second input terminal 31*b* is output to the right front loudspeaker 11*b* and the band separating unit 32.

Note that, although not shown in FIG. 2, a D/A converter and an amplifier are provided between the input unit 31 and each of the left front loudspeaker 11*a* and the right front loudspeaker 11*b*. The left stereo signal L which has undergone D/A conversion with the D/A converter and has been amplified by the amplifier is output to the left front loudspeaker 11*a*, and the right stereo signal R which has undergone D/A conversion with the D/A converter and has been amplified by the amplifier is output to the right front loudspeaker 11*b*.

To the band separating unit 32, the left stereo signal L is input from the first input terminal 31*a* and the right stereo signal R is input from the second input terminal 31*b*.

The band separating unit 32 includes a low pass filter 32*a* and a high pass filter 32*b*. The left stereo signal L and the right stereo signal R input to the band separating unit 32 are input to the low pass filter 32*a* and the high pass filter 32*b*, respectively.

When the left stereo signal L and the right stereo signal R are input, the low pass filter 32*a* outputs, to the generating unit 33 on the downstream, the left stereo signal L and the right stereo signal R that are in a preset low frequency band, out of the input left stereo signal L and right stereo signal R. The preset low frequency band corresponds to a first frequency band.

Hereafter, a left stereo signal, in the low frequency band, which has passed through the low pass filter 32*a* is expressed as a left stereo signal L(Low), and a right stereo signal in the low frequency band is expressed as a right stereo signal R(Low).

When the left stereo signal L and the right stereo signal R are input, the high pass filter 32*b* outputs, to the extracting unit 34 on the downstream, the left stereo signal L and the right stereo signal R that are in a preset high frequency band, out of the input left stereo signal L and right stereo signal R. The preset high frequency band corresponds to a second frequency band.

Hereafter, a left stereo signal, in the high frequency band, which has passed through the high pass filter 32*b* is expressed as a left stereo signal L(High), and a right stereo signal in the high frequency band is expressed as a right stereo signal R(High).

To the generating unit 33, the left stereo signal L(Low) and the right stereo signal R(Low) are input. The generating unit 33 is composed of an adder that adds the left stereo signal and the right stereo signal. When the left stereo signal L(Low) and the right stereo signal R(Low) are input, the generating unit 33 generates a monaural signal by a sum and difference scheme.

Specifically, the generating unit 33 outputs, to the first combining unit 35, a sum signal of the input left stereo signal L(Low) and right stereo signal R(Low) as the monaural signal. The monaural signal output from the generating unit 33 is expressed as a monaural signal {L(Low)+R(Low)}.

To the extracting unit 34, the left stereo signal L(High) and the right stereo signal R(High) are input. The extracting unit 34 is composed of a subtracter that subtracts one of the left stereo signal and the right stereo signal from the other. When the left stereo signal L(High) and the right stereo signal R(High) are input, the extracting unit 34 generates a stereo signal by a sum and difference scheme.

Specifically, the extracting unit 34 outputs, to the first combining unit 35, a difference signal of the left stereo signal L(High) and the right stereo signal R(High) as a stereo component. Namely, the extracting unit 34 removes a monaural component in the high frequency band by subtracting the right stereo signal R(High) from the left stereo signal L(High), to extract the stereo component. The difference signal output to the first combining unit 35 is expressed as a stereo difference signal {L(High)−R(High)}. The stereo difference signal {L(High)−R(High)} corresponds to a stereo component for an L-channel.

Moreover, the extracting unit 34 outputs, to the second combining unit 36, a difference signal of the right stereo signal R(High) and the left stereo signal L(High) as a stereo component. The extracting unit 34 removes the monaural component in the high frequency band by subtracting the left stereo signal L(High) from the right stereo signal R(High), to extract the stereo component. The difference signal output to the second combining unit 36 is expressed as a stereo difference signal {R(High)−L(High)}. The stereo difference signal {R(High)−L(High)} corresponds to a stereo component for an R-channel.

To the first combining unit 35, the monaural signal {L(Low)+R(Low)} and the stereo difference signal {L(High)−R(High)} are input.

The first combining unit 35 is composed of an adder. The first combining unit 35 adds the monaural signal {L(Low)+R(Low)} and the stereo difference signal {L(High)−R(High)}. The first combining unit 35 outputs, to the left rear loudspeaker 13*a* and the right rear loudspeaker 13*b*, a first combined signal having the monaural signal {L(Low)+R(Low)} and the stereo difference signal {L(High)−R(High)} combined.

Note that, although not shown in FIG. 2, a D/A converter and an amplifier are provided on the downstream of the first combining unit 35, and the first combined signal which has undergone D/A conversion with the D/A converter and been amplified by the amplifier is output to the left rear loudspeaker 13*a* and the right rear loudspeaker 13*b*. Moreover, as to the amplifier, a common amplifier is used for the left rear loudspeaker 13*a* and the right rear loudspeaker 13*b*.

To the second combining unit 36, the monaural signal {L(Low)+R(Low)} and the stereo difference signal {R(High)−L(High)} are input.

The second combining unit 36 is composed of an adder. The second combining unit 36 adds the monaural signal {L(Low)+R(Low)} and the stereo difference signal {R(High)−L(High)}. The second combining unit 36 outputs, to the exciter 15, a second combined signal having the monaural signal {L(Low)+R(Low)} and the stereo difference signal {R(High)−L(High)} combined.

Note that, although not shown in FIG. 2, a D/A converter and an amplifier are provided on the downstream of the second combining unit 36, and the second combined signal which has undergone D/A conversion with the D/A converter and been amplified by the amplifier is output to the exciter 15.

Figure 3A:
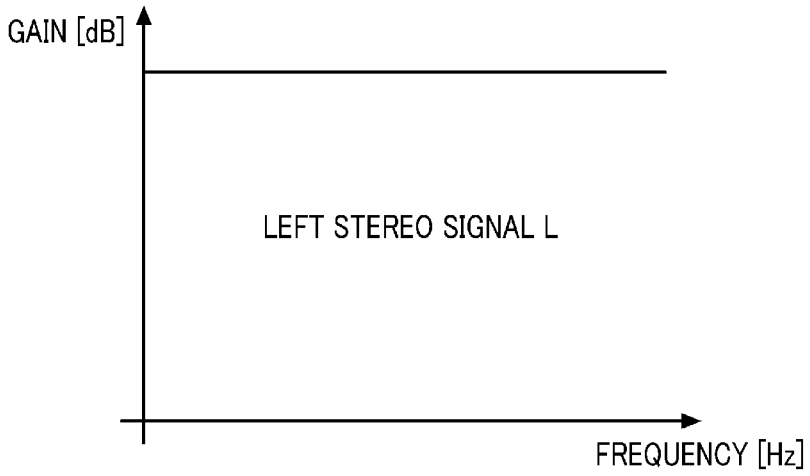
FIGS. 3A and 3B are diagrams showing relationships between frequencies and gains of acoustic signals input to a left front loudspeaker and a right front loudspeaker.
Figure 3B:
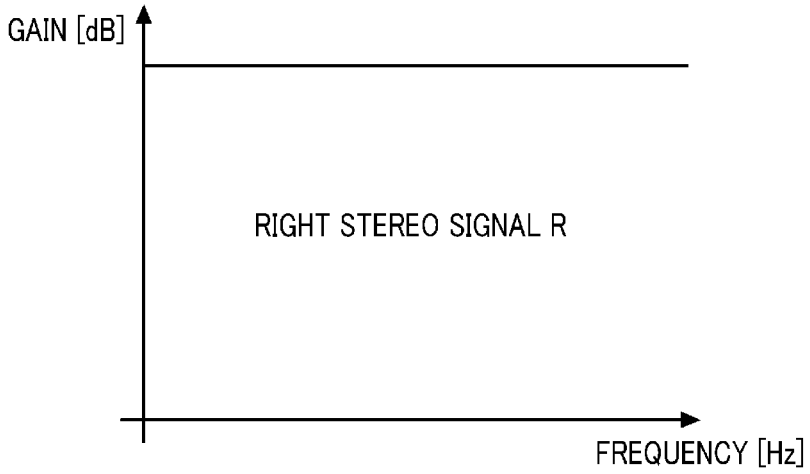

FIG. 3A is a diagram showing a relationship between a frequency and a gain of an acoustic signal input to the left front loudspeaker 11*a*. FIG. 3B is a diagram showing a relationship between a frequency and a gain of an acoustic signal input to the right front loudspeaker 11*b*.

The left stereo signal L is input to the left front loudspeaker 11*a* and the right stereo signal R is input to the right front loudspeaker 11*b*. The left stereo signal L and the right stereo signal R are the left stereo signal L and the right stereo signal R that are input to the input unit 31. Therefore, an acoustic signal output by the left front loudspeaker 11*a* shows flat characteristics in terms of the gain over the whole frequency band, and an acoustic signal output by the right front loudspeaker 11*b* shows flat characteristics in terms of the gain over the whole frequency band.

Figure 4A:
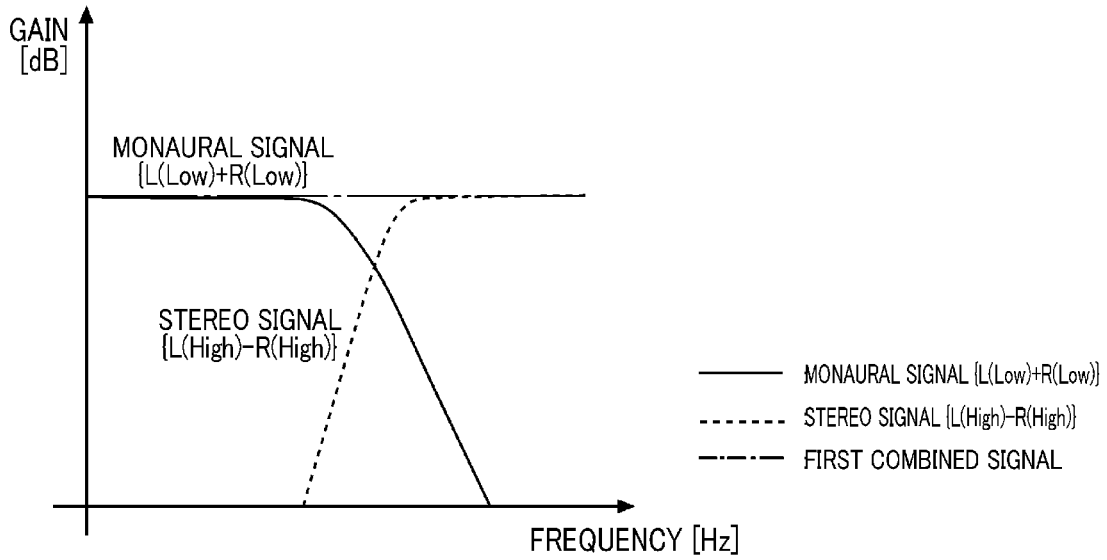
FIGS. 4A and 4B are diagrams showing relationships between frequencies and gains of acoustic signals input to a left rear loudspeaker, a right rear loudspeaker and an exciter.
Figure 4B:
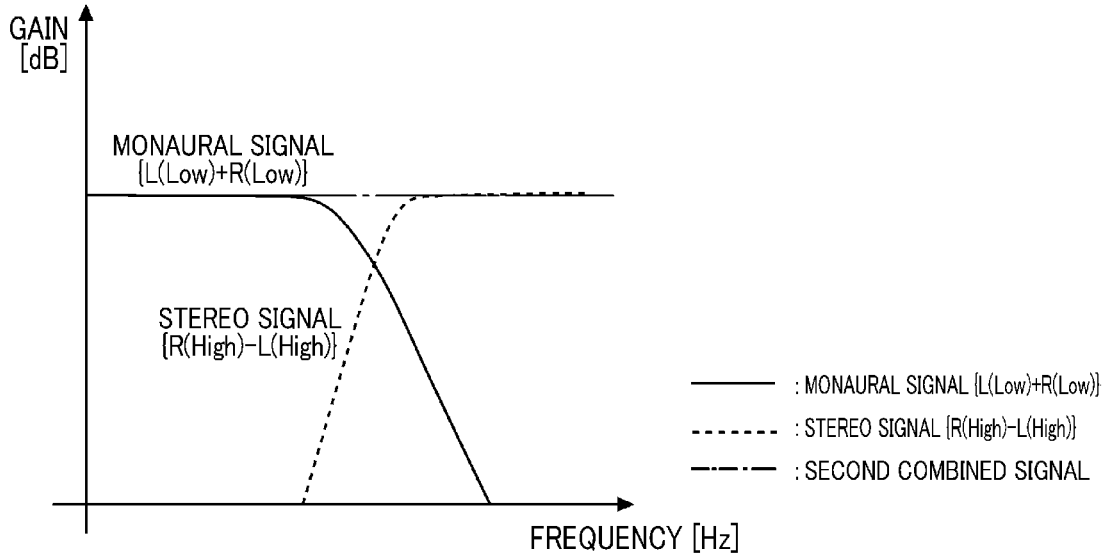

FIG. 4A is a diagram showing relationships between frequencies and gains of acoustic signals input to the left rear loudspeaker 13*a* and the right rear loudspeaker 13*b*. FIG. 4B is a diagram showing relationships between frequencies and gains of acoustic signals input to the exciter 15.

The signals indicated by the solid lines in FIG. 4A and FIG. 4B show the relationships between the frequencies and the gains of the monaural signal {L(Low)+R(Low)}. Moreover, the signal indicated by the broken line in FIG. 4A shows the relationship between the frequency and the gain of the stereo difference signal {L(High)−R(High)}. The signal indicated by the broken line in FIG. 4B shows the relationship between the frequency and the gain of the stereo difference signal {R(High)−L(High)}.

Moreover, the signal indicated by the dot and dash line in FIG. 4A shows the relationship between the frequency and the gain of the first combined signal having the monaural signal {L(Low)+R(Low)} and the stereo difference signal {L(High)−R(High)} combined. Moreover, the signal indicated by the dot and dash line in FIG. 4B shows the relationship between the frequency and the gain of the second combined signal having the monaural signal {L(Low)+R(Low)} and the stereo difference signal {R(High)−L(High)} combined.

To the left rear loudspeaker 13*a* and the right rear loudspeaker 13*b*, the first combined signal having the monaural signal {L(Low)+R(Low)} and the stereo difference signal {L(High)−R(High)} combined is input. Therefore, the left rear loudspeaker 13*a* and the right rear loudspeaker 13*b* output sounds corresponding to the monaural signal {L(Low)+R(Low)} in the low frequency band, and outputs sounds corresponding to the stereo difference signal {L(High)−R(High)} in the high frequency band.

Moreover, to the exciter 15, the second combined signal having the monaural signal {L(Low)+R(Low)} and the stereo difference signal {R(High)−L(High)} combined is input. Therefore, the exciter 15 outputs a sound corresponding to the monaural signal {L(Low)+R(Low)} in the low frequency band, and outputs a sound corresponding to the stereo difference signal {R(High)−L(High)} in the high frequency band.

Accordingly, the left rear loudspeaker 13*a*, the right rear loudspeaker 13*b* and the exciter 15 produce a stereophonic feeling, and the presence of the sound heard by a listener can be improved.

As described above, the acoustic device 10 of the present embodiment includes the band separating unit 32, the generating unit 33, the extracting unit 34, the first combining unit 35, the second combining unit 36, the left front loudspeaker 11*a* and the right front loudspeaker 11*b*, the left rear loudspeaker 13*a* and the right rear loudspeaker 13*b*, and the exciter 15.

The band separating unit 32 separates the frequency band for the left stereo signal L and the right stereo signal R into the low frequency band and the high frequency band.

The generating unit 33 generates the monaural signal {L(Low)+R(Low)} on the basis of the left stereo signal L(Low) in the separated low frequency band and the right stereo signal R(Low) in the low frequency band.

The extracting unit 34 generates the stereo difference signal {L(High)−R(High)} by subtracting the right stereo signal R(High) in the high frequency band from the left stereo signal L(High) in the separated high frequency band.

Moreover, the extracting unit 34 generates the stereo difference signal {R(High)−L(High)} by subtracting the left stereo signal L(High) in the high frequency band from the right stereo signal R(High) in the separated high frequency band.

The first combining unit 35 combines the monaural signal {L(Low)+R(Low)} and the stereo difference signal {L(High)−R(High)} to generate the first combined signal.

The second combining unit 36 combines the monaural signal {L(Low)+R(Low)} and the stereo difference signal {R(High)−L(High)} to generate the second combined signal.

The left front loudspeaker 11*a* and the right front loudspeaker 11*b* output, into the vehicle cabin 3, the sounds based on the left stereo signal L and the right stereo signal R input to the acoustic processing device 30.

The left rear loudspeaker 13*a* and the right rear loudspeaker 13*b* output, into the vehicle cabin 3, the sounds based on the first combined signal.

The exciter 15 outputs, into the vehicle cabin 3, the sound based on the second combined signal.

When the exciter 15 is newly added to the acoustic device 10 without changing the number of channels, there has conventionally been employed a configuration in which a monaural signal generated on the basis of the left stereo signal L and the right stereo signal R is output to the left rear loudspeaker 13*a*, the right rear loudspeaker 13*b* and the exciter 15.

Since such a conventional configuration however causes the monaural signal to be output from the left rear loudspeaker 13*a*, the right rear loudspeaker 13*b* and the exciter 15, loudspeakers that produce the stereophonic feeling have been the left front loudspeaker 11*a* and the right front loudspeaker 11*b* only, which results in deterioration of the presence of a sound field.

In contrast, the acoustic device 10 of the present embodiment outputs, from the left rear loudspeaker 13*a* and the right rear loudspeaker 13*b*, the first combined signal having the stereo difference signal {L(High)−R(High)} combined to the monaural signal {L(Low)+R(Low)} and outputs, from the exciter 15, the second combined signal having the stereo difference signal {R(High)−L(High)} combined to the monaural signal {L(Low)+R(Low)}.

Accordingly, the left rear loudspeaker 13*a*, the right rear loudspeaker 13*b* and the exciter 15 produce the stereophonic feeling, which can improve the presence of the sound heard by a listener. Therefore, the exciter 15 can be added without changing the number of output channels, and sound quality can be improved.

Moreover, since the generating unit 33 generates the monaural signal {L(Low)+R(Low)} by adding the left stereo signal L(Low) in the low frequency band and the right stereo signal R(Low) in the low frequency band, it is easy to generate the monaural signal.

Moreover, the extracting unit 34 generates the stereo difference signal {L(High)−R(High)} by subtracting the right stereo signal R(High) in the high frequency band from the left stereo signal L(High) in the separated high frequency band, and generates the stereo difference signal {R(High)−L(High)} by subtracting the left stereo signal L(High) in the high frequency band from the right stereo signal R(High) in the separated high frequency band. It is therefore easy to extract the stereo components.

The aforementioned embodiment merely exemplarily shows an aspect of the present invention and any of modifications and applications thereof may occur without departing from the spirit of the present invention.

For example, there may be output the second combined signal having the monaural signal {L(Low)+R(Low)} and the stereo difference signal {R(High)−L(High)} combined to the left rear loudspeaker 13*a* and the right rear loudspeaker 13*b*, and there may be output the first combined signal having the monaural signal {L(Lo w)+R(Low)} and the stereo difference signal {L(High)−R(High)} combined to the exciter 15.

Moreover, while the generating unit 33 and the extracting unit 34 generate the monaural signal and the stereo component signal by a sum and difference scheme, the monaural component and the stereo component may be extracted using an adaptive filter.

Moreover, the configuration of the acoustic processing device 30 shown in FIG. 2 is a schematic diagram in which these functions included in the device are categorized and shown by the main processing details. The configuration of the acoustic processing device 30 may be segmented into further more blocks on the basis of the processing details. Moreover, such a functional block may be configured so as to perform further more processing steps than those of one block in FIG. 2. Moreover, the processing of each block may be performed by a single device of hardware or may be performed by a plurality of devices of hardware. Moreover, the processing of each block may be realized by one program or may be realized by a plurality of programs.

Moreover, the acoustic processing device 30 may be provided to any space or room, not limitedly to the vehicle cabin 3 of the vehicle 1.

REFERENCE SIGNS LIST

1 Vehicle
3 Vehicle cabin (space)
10 Acoustic device
11*a* Left front loudspeaker
11*b* Right front loudspeaker
13*a* Left rear loudspeaker
13*b* Right rear loudspeaker
15 Exciter
17 Front seat
19 Rear seat
20 Sound source device
30 Acoustic processing device
31 Input unit
31*a* First input terminal
31*b* Second input terminal
32 Band separating unit
32*a* Low pass filter
32*b* High pass filter
33 Generating unit
34 Extracting unit
35 First combining unit
36 Second combining unit

What is claimed is:

1. An acoustic device comprising:

a band separating unit that includes a low pass filter and a high pass filter and separates a frequency band for input L-channel acoustic signal and R-channel acoustic signal into a first frequency band and a second frequency band which is a frequency band different from the first frequency band;

a generating unit that includes a generating adder which is an adder and that generates a monaural signal by adding the L-channel acoustic signal in the first frequency band and the R-channel acoustic signal in the first frequency band;

an extracting unit that includes a subtracter and extracts a stereo component for an L-channel by subtracting the R-channel acoustic signal in the second frequency band from the L-channel acoustic signal in the second frequency band and extracts a stereo component for an R-channel by subtracting the L-channel acoustic signal in the second frequency band from the R-channel acoustic signal in the second frequency band;

a first combining unit that includes a first adder which is an adder and that combines the monaural signal and the stereo component for the L-channel to generate a first combined signal;

a second combining unit that includes a second adder which is an adder and that combines the monaural signal and the stereo component for the R-channel to generate a second combined signal;

a first sound outputting device that outputs, into a space, a sound based on the input L-channel acoustic signal and R-channel acoustic signal;

a second sound outputting device that outputs, into the space, a sound based on the first combined signal; and a third sound outputting device that outputs, into the space, a sound based on the second combined signal, wherein the third sound outputting device is an exciter or a center loudspeaker which is arranged on a center line of the space in a width direction.

2. The acoustic device according to claim 1, wherein the band separating unit separates the input L-channel acoustic signal and R-channel acoustic signal into a low frequency band which is the first frequency band and a high frequency band which is the second frequency band.

3. An acoustic device comprising:

a band separating unit that includes a low pass filter and a high pass filter and separates a frequency band for input L-channel acoustic signal and R-channel acoustic signal into a first frequency band and a second frequency band which is a frequency band different from the first frequency band;

a generating unit that includes a generating adder which is an adder and that generates a monaural signal by adding the L-channel acoustic signal in the first frequency band and the R-channel acoustic signal in the first frequency band;

an extracting unit that includes a subtracter and extracts a stereo component for an L-channel by subtracting the R-channel acoustic signal in the second frequency band from the L-channel acoustic signal in the second frequency band and extracts a stereo component for an R-channel by subtracting the L-channel acoustic signal in the second frequency band from the R-channel acoustic signal in the second frequency band;

a first combining unit that includes a first adder which is an adder and that combines the monaural signal and the stereo component for the L-channel to generate a first combined signal;

a second combining unit that includes a second adder which is an adder and that combines the monaural signal and the stereo component for the R-channel to generate a second combined signal;

a first sound outputting device that outputs, into a space, a sound based on the input L-channel acoustic signal and R-channel acoustic signal;

a second sound outputting device that outputs, into the space, a sound based on the first combined signal; and a third sound outputting device that outputs, into the space, a sound based on the second combined signal, wherein the second sound outputting device is an exciter or a center loudspeaker which is arranged on a center line of the space in a width direction.

* * * * *